US006568356B1

(12) United States Patent
Hayakawa et al.

(10) Patent No.: US 6,568,356 B1
(45) Date of Patent: May 27, 2003

(54) COOLING WATER FLOW CONTROL SYSTEM FOR INTERNAL COMBUSTION ENGINE

(75) Inventors: Masaharu Hayakawa, Obu (JP); Takashi Horibe, Obu (JP); Shigeru Arakawa, Obu (JP); Hidenori Hirosawa, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/045,308

(22) Filed: Jan. 10, 2002

(51) Int. Cl.[7] ..... F01P 7/14
(52) U.S. Cl. ..... 123/41.1; 123/41.29
(58) Field of Search ..... 123/41.1, 41.13, 123/41.29

(56) References Cited

FOREIGN PATENT DOCUMENTS

JP 02-125910 5/1999

*Primary Examiner*—Noah P. Kamen
(74) *Attorney, Agent, or Firm*—Baker Botts L.L.P.

(57) ABSTRACT

The object of the present invention is to promote warming-up operation in a cooling water flow control system of an internal combustion engine. A flow control valve is provided at a junction of a radiator passage and a bypass passage. Radiator flow rate and bypass flow rate of the flow control vale are controlled by detecting engine outlet water temperature, radiator outlet water temperature, number of revolutions of engine, and suction pipe negative pressure. The cooling water in the bypass passage passes through a throttle body, and flow rate is controlled to a totally closed flow rate or a micro-flow rate in the warming-up operation, and this contributes to the promotion of the warming-up operation.

3 Claims, 6 Drawing Sheets

FIG.4A

| Ne \ Pb | ~837 | ~759 | ~681 | ~603 | ~525 | ~447 | ~369 | ~291 |
|---|---|---|---|---|---|---|---|---|
| 750~ | $S_{01}$ | $S_{02}$ | $S_{03}$ | $S_{04}$ | $S_{05}$ | $S_{06}$ | $S_{07}$ | $S_{08}$ |
| 1000~ | $S_{11}$ | $S_{12}$ | $S_{13}$ | $S_{14}$ | $S_{15}$ | $S_{16}$ | $S_{17}$ | $S_{18}$ |
| 1250~ | $S_{21}$ | $S_{22}$ | $S_{23}$ | $S_{24}$ | $S_{25}$ | $S_{26}$ | $S_{27}$ | $S_{28}$ |
| 1500~ | $S_{31}$ | $S_{32}$ | $S_{33}$ | $S_{34}$ | $S_{35}$ | $S_{36}$ | $S_{37}$ | $S_{38}$ |

FIG.4B

| $\Delta T$ | 10 | 20 | 30 | 40 | 50 | 60 | 70 | 80 |
|---|---|---|---|---|---|---|---|---|
| K | $K_1$ | $K_2$ | $K_3$ | $K_4$ | $K_5$ | $K_6$ | $K_7$ | $K_8$ |

FIG.6

| OBJECT UNDER TESTING | CONTROL METHOD | BYPASS PASSAGE | | | TOTAL BYPASS FLOW RATE (ℓ/MIN) (FOR REFERENCE) | RADIATOR PASSAGE | TIME REQUIRED FOR TEMPERATURE INCREASE (SECONDS) (38℃⇨78℃) |
|---|---|---|---|---|---|---|---|
| | | 3RD BYPASS PASSAGE (HEATER CORE) | 2ND BYPASS PASSAGE (RESTRICTOR) | 1ST BYPASS PASSAGE (EGR,THR) | | | |
| CONVENTIONAL EXAMPLE | FLOW CONTROL VALVE | TOTALLY CLOSED | 1 ℓ/MIN | TOTALLY OPENED | 11 ℓ/MIN | TOTALLY CLOSED | 252SECONDS |
| COMPARATIVE EXAMPLE | ⇧ | ⇧ | TOTALLY CLOSED | 1 ℓ/MIN | 1 ℓ/MIN | ⇧ | 250SECONDS |
| THE PRESENT INVENTION | ⇧ | ⇧ | 1 ℓ/MIN | TOTALLY CLOSED | 1 ℓ/MIN | ⇧ | 187SECONDS |

COOLING WATER FLOW CONTROL SYSTEM FOR INTERNAL COMBUSTION ENGINE

BACKGROUND OF THE INVENTION

The present invention relates to a cooling water flow control system for an internal combustion engine used for the control of radiator flow rate and bypass flow rate for the purpose of controlling engine temperature. In an internal combustion engine used in automobile, it is designed in such manner that cooling water does not flow to radiator during warming-up operation (in fact, cooling water is passed at very low flow rate to a bypass passage in order not to increase the load of water pump), and overheating is prevented by passing the cooling water to the radiator after the warming-up operation has been completed. During light load operation, the quantity of circulating water to the radiator is relatively reduced, and a target cooling water temperature is set to a relatively high level and this is to decrease heat loss (to improve combustion efficiency), to promote purification of exhaust gas, and to decrease friction loss in the engine. Also, during total load operation, the quantity of circulating water to the radiator is relatively increased and the target cooling water temperature is set to a relatively low level in order to improve suction air filling efficiency and to prevent knocking. For the water temperature control as described above, water jacket of engine is connected to the radiator via a radiator passage. The flow control valve is provided at a junction of a bypass passage (used to bypass the radiator) and the radiator passage, and radiator flow rate and bypass flow rate are controlled by the flow control valve. (For instance, see JP-A-2-125910).

In the conventional technique, radiator passage is closed during the warming-up operation, and the quantity of the cooling water in the bypass passage is decreased to promote the warming-up operation, but considerable time is required for the warming-up operation. Also, when it is shifted from light load operation to total load operation, the temperature is immediately controlled to the target water temperature suitable for total load operation. In this respect, when it is shifted to light load operation immediately after it has been shifted to total load operation, the response to the light load operation may be delayed, and hunting in water temperature control may occur.

SUMMARY OF THE INVENTION

It is a first object of the present invention to promote the warming-up operation in a cooling water flow control system of an internal combustion engine. It is a second object of the invention to prevent response delay or hunting in water temperature control when it is shifted to light load operation immediately after it has been shifted from light load operation to total load operation. It is a third object of the invention to accelerate control operation after it has been shifted from total load operation to light load operation or from light load operation to total load operation.

A first aspect of the present invention provides a cooling water flow control system in an internal combustion engine, which comprises a flow control valve at a junction of a radiator passage and a bypass passage, said flow control system being used for control of radiator flow rate and bypass flow rate of the flow control valve by detecting engine outlet water temperature, radiator outlet temperature, number of revolutions of engine, and suction pipe negative pressure, whereby cooling water in the bypass passage passes through a throttle body, and flow rate is set to totally closed flow rate or micro-flow rate during the warming-up operation.

A second aspect of the present invention provides a cooling water flow control system according to the first aspect of the invention, wherein, when it is shifted from light load operation to total load operation, radiator flow rate and bypass flow rate are maintained at current values for a predetermined time, radiator flow rate and bypass flow rate are calculated from number of revolutions of engine and suction pipe negative pressure after the predetermined time, a correction value is calculated from engine outlet water temperature and radiator outlet water temperature, the flow control valve is quickly controlled to adjust the corrected radiator flow rate and bypass flow rate and is maintained at its position, and feedback control of water temperature is performed after the cooling water temperature has reached "target water temperature ± preset temperature".

A third aspect of the present invention provides a cooling water flow control system according to the first and the second aspects of the invention, wherein, when it is shifted from total load operation to light load operation, radiator flow rate and bypass flow rate are calculated from number of revolutions of engine and suction pipe negative pressure, a correction value is calculated from engine outlet water temperature and radiator outlet water temperature, the flow control valve is quickly controlled to adjust to the corrected radiator flow rate and bypass flow rate and it is maintained at its position, and feedback control of water temperature is performed after the cooling water temperature has reached "target water temperature ± preset temperature".

According to the first aspect of the present invention, bypass flow rate is controlled to totally-closed flow rate or micro-flow rate during the warming-up operation. As a result, the cooling due to suction air flowing in the throttle body of the bypass passage is prevented, and this contributes to the promotion of the warming-up operation and the warming-up operation can be achieved at earlier time.

According to the second aspect of the present invention, when it is shifted from light load operation to total load operation, radiator flow rate and bypass flow rate are maintained to current values for a predetermined time. As a result, even when it is shifted to light load operation immediately after the shifting from light load operation to total load operation, response delay or hunting in water temperature control does not occur.

According to the second aspect and the third aspect of the present invention, after it is shifted from total load, operation to light load operation or from light load operation to total load operation, radiator flow rate and bypass flow rate are calculated from number of revolutions of engine and suction pipe negative pressure. A correction value is calculated from engine outlet water temperature and radiator outlet water temperature. The flow control valve is quickly controlled to adjust to the corrected radiator flow rate and the corrected bypass flow rate, and the valve is maintained at its position. After the cooling water temperature reaches the level of "target water temperature ± preset temperature", feedback control of water temperature is performed. Therefore, control operation after the shifting is accelerated, and cooling water temperature reaches the target water temperature at earlier time.

BRIEF DESCRIPTION OF THE DRAWINGS

FIG. 4(*a*) represents a data map for determining a target water quantity from suction pipe negative pressure and from number of revolutions of engine, and FIG. 4 (*b*) is a data map for determining a correction value from engine outlet water temperature and radiator outlet water temperature;

FIG. 6 is a table showing control procedure during warming-up operation and experiment results in a conventional example, a comparative example, and an example according to the present invention.

DESCRIPTION OF THE PREFERRED EMBODIMENT

Figure 1:
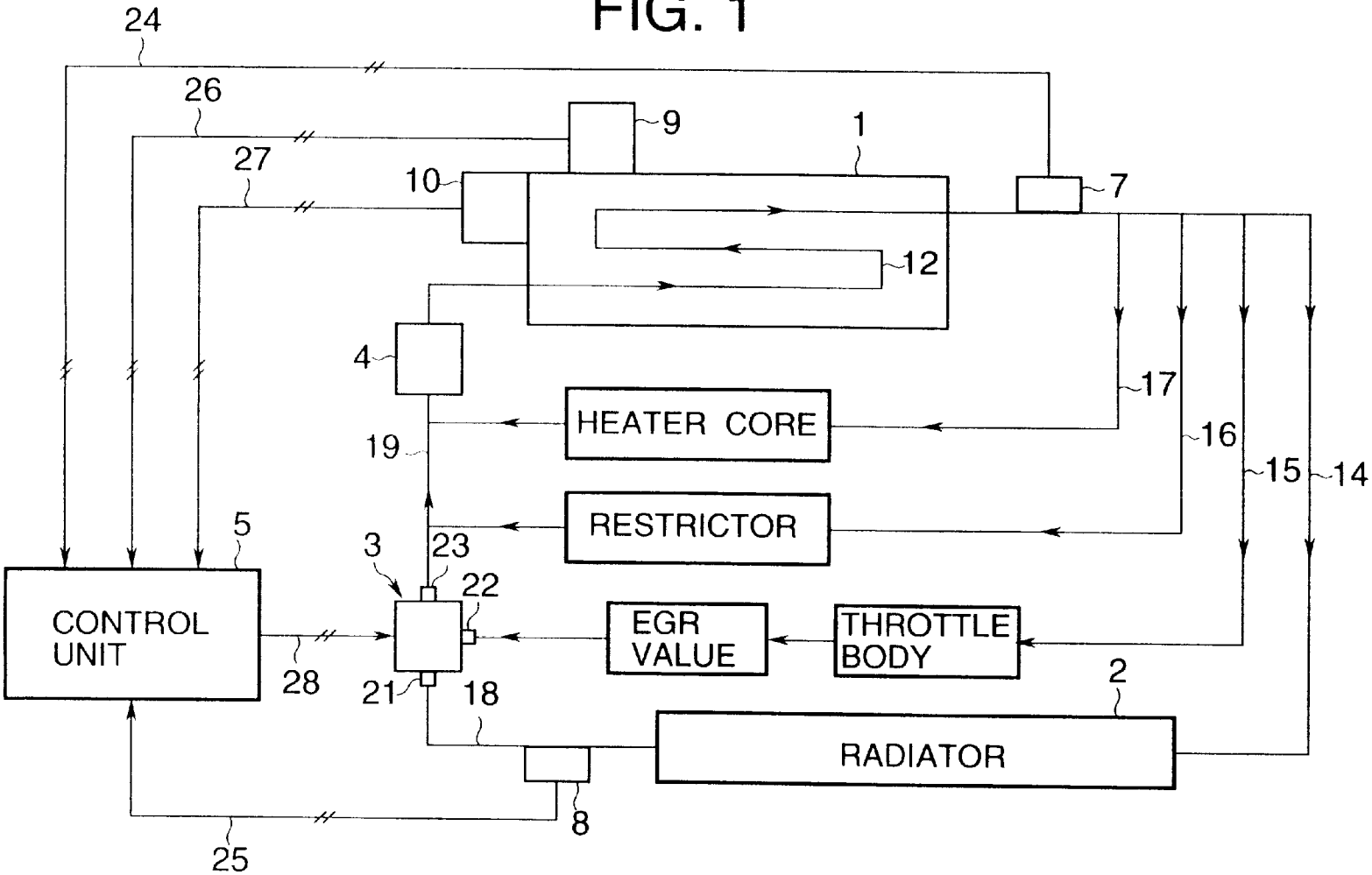
FIG. 1 is a block diagram of a cooling water flow control system according to the present invention.

FIG. 1 to FIG. 5 each represents an embodiment of a cooling water flow control system of an internal combustion engine according to the present invention. In FIG. 1, an engine outlet water temperature sensor 7 is provided at an outlet of a water jacket 12 of an engine main body 1. Further, a radiator inlet side passage 14, a first bypass passage 15, a second bypass passage 16, and a third bypass passage 17 are connected to the engine main body at inlet side of each passage. Outlet side of the radiator inlet side passage 14 is connected to an inlet of a radiator 2. At an outlet of the radiator 2, a radiator outlet water temperature sensor 8 is mounted. The outlet of the radiator 2 is connected to a first inlet port 21 of a flow control valve 3 via a radiator outlet side passage 18. The outlet side of the first bypass passage 15 is connected to a second inlet port of the flow control valve 3. As a result, the flow control valve 3 is positioned at a junction of the radiator outlet side passage 18 and the first bypass passage 15.

It is designed in such manner that the cooling water in the first bypass passage 15 passes trough a throttle body and an EGR valve. During warming-up operation, flow rate in the first bypass passage 15 is controlled to a totally closed flow rate or to a micro-flow rate (less than 1 liter/min) by the flow control valve 3. The flow rate in the first bypass passage 15 is controlled to the totally closed flow rate or the micro-flow rate (minimum flow rate) during warming-up operation, and this is to extensively improve the warming-up operation by preventing the cooling due to suction air flowing through the throttle body. An outlet port 23 of the flow control valve 3 is connected to the inlet of the water jacket 12 of the engine main body 1 via a suction passage 19, and a water pump 4 is provided in the suction passage 19. By the operation of the water pump 4, the cooling water flows in arrow direction as shown in FIG. 1.

Outlet-sides of the second bypass passage 16 and the third bypass passage 17 are connected respectively to the suction passage 19 upstream of the water pump 4. A restrictor is arranged on the second bypass passage 16, and flow rate in the second bypass passage 16 is regulated by the restrictor. The cooling water in the third bypass passage 17 can pass through heater core such as air-conditioner of automobile. When air-conditioner is not used, the third bypass passage 17 is shut off. Engine outlet water temperature, radiator outlet water temperature, suction pipe negative pressure, and number of revolutions of engine as detected respectively by an engine outlet water temperature sensor 7, a radiator outlet water temperature sensor 8, a suction pipe negative pressure sensor 9 and a rotation sensor 10 are inputted to a control unit 5 via lines 24 to 27 respectively.

Figure 2:
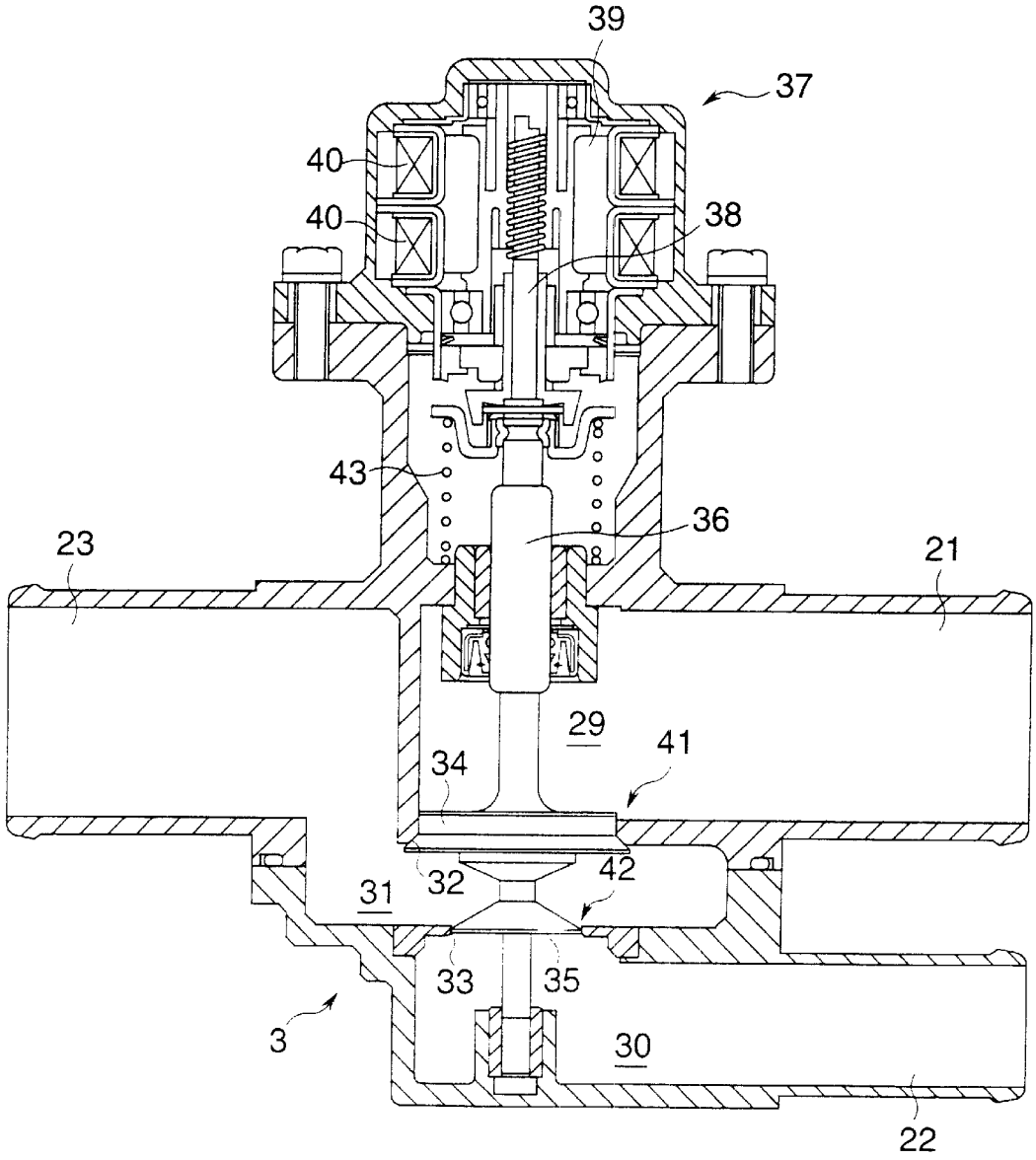
FIG. 2 is a cross-sectional view of a flow control valve equipped with a step motor.

As shown in FIG. 2, a first inlet port 21, a second inlet port 22, and an outlet port 23 of the flow control valve 3 are connected respectively to a first inlet chamber 29, a second inlet chamber 30 and an outlet chamber 31. A first valve seat 32 is arranged between the first inlet chamber 29 and the outlet chamber 31, and a second valve seat 33 is arranged between the second inlet chamber 30 and the outlet chamber 31. The lower end and the upper portion of a valve shaft 36 are slidably supported on a bearing, and a first valve disc 34 and a second valve disc 35 are connected with the valve shaft 36. The valve shaft 36 is resiliently pushed upward by a spring 43, and the upper end of the valve shaft 36 is engaged with the lower end of a driving shaft 38 of a step motor 37. Male screw on the upper portion of the driving shaft 38 is engaged with female screw of a rotor 39. When a signal from the control unit 5 is inputted to a coil 40 via a line 28, the rotor 39 is rotated stepwise in response to the input signal, and the driving shaft 38 is moved in linear direction.

A radiator flow regulating valve 41 (a first valve) comprises the first valve disc 34 and the first valve seat 32, and a bypass flow regulating valve 42 (a second valve) comprises the second valve disc 35 and the second valve seat 33. The radiator flow regulating valve 41 and the bypass flow regulating valve 42 are resiliently pushed in closing direction by a spring 43, and the valve is opened to a valve opening corresponding to the movement of the driving shaft 38. In FIG. 2, there is an annular contact member in the first valve disc 34, and the bypass flow regulating valve 42 is slightly opened and the radiator flow regulating valve 41 is closed when the valve shaft 36 is slightly moved down.

Figure 3:
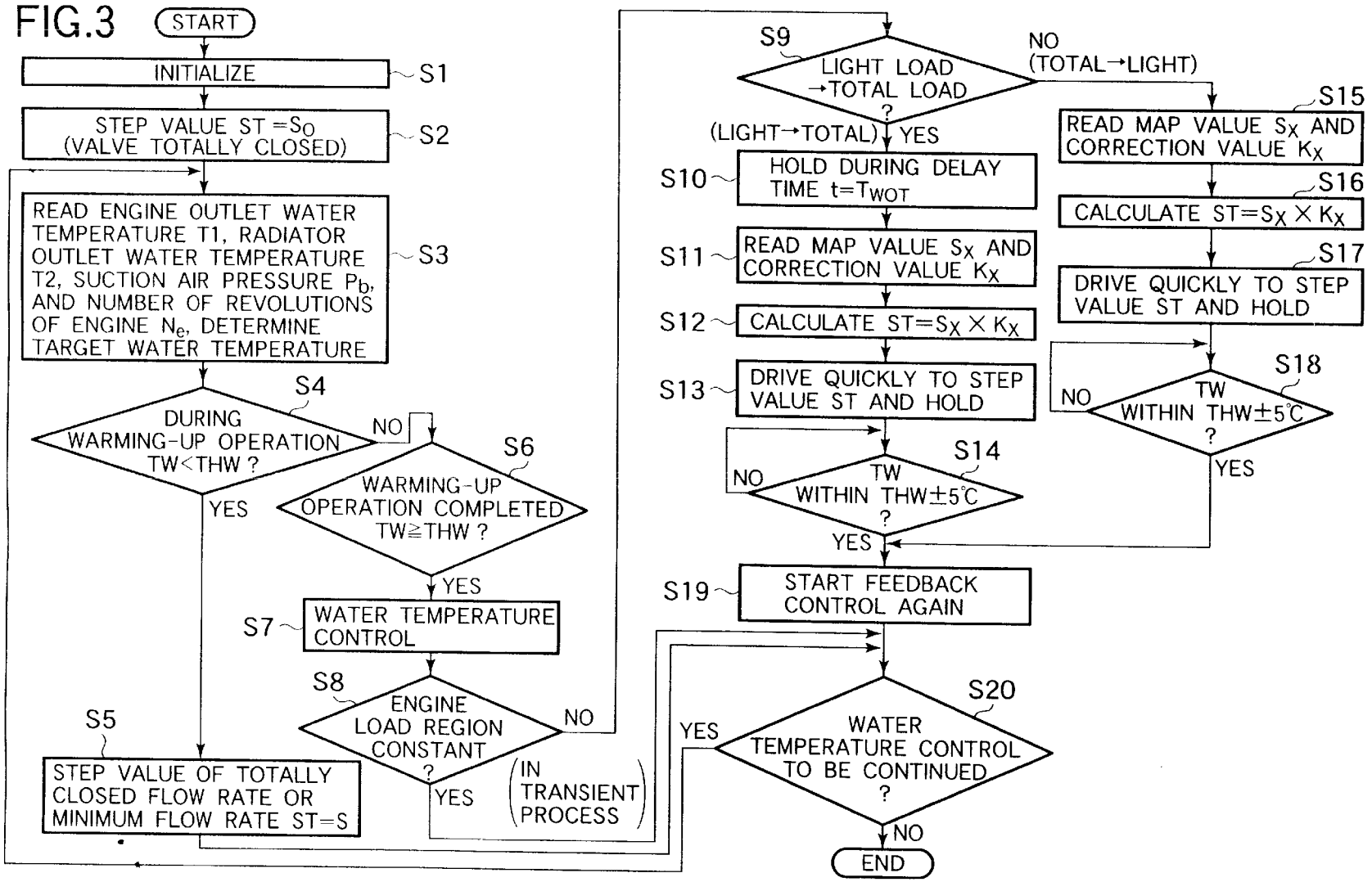
FIG. 3 is a flow chart for flow rate control of cooling water.
Figure 5:
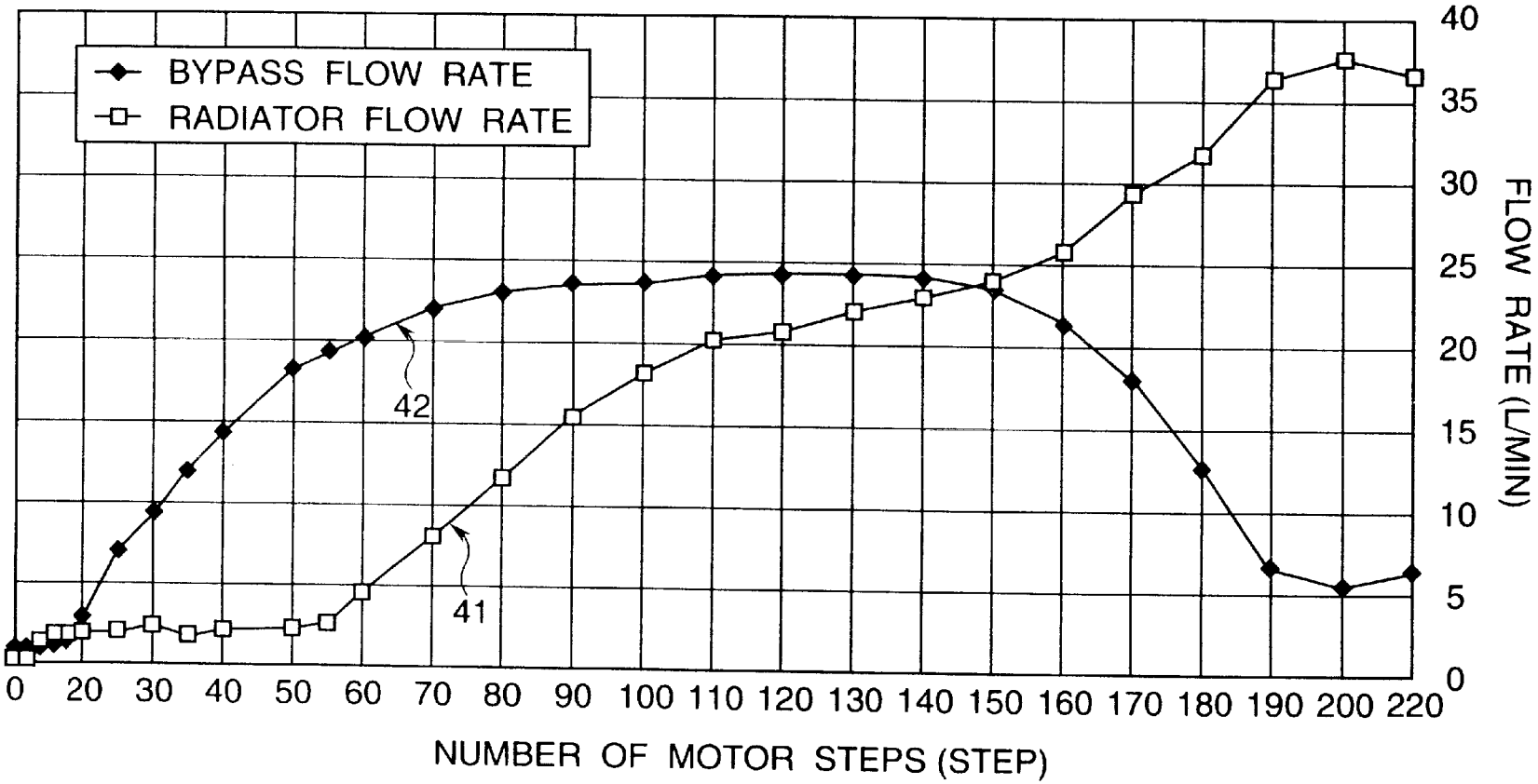
FIG. 5 is a diagram showing relationship between number of motor steps and radiator flow rate and bypass flow rate.

Now, description will be given on water temperature control of the cooling water referring to the flow chart of FIG. 3. The relationship between number of steps inputted to the step motor 37 and radiator flow rate bypass flow rate of the flow control valve 3 (i.e. opening of the radiator flow regulating valve 41 and the bypass flow regulating valve 42) is set as shown in FIG. 5. The step motor 37 is driven by obtaining step values in the order shown in the flow chart. The radiator flow rate and the bypass flow rate are regulated to the values to match the number of steps, and the cooling water temperature is controlled at the desired or target temperature value.

Initialization is performed in Step S1. In Step S2, a step value ST of the step motor 37 is set to $S_0$, and the radiator flow regulating valve 41 and the bypass flow regulating valve 42 are both totally closed. In Step S3, engine outlet water temperature T1, radiator outlet water temperature T2, suction pipe negative pressure $P_b$, and number of revolutions of engine $N_e$ are read. Based on the suction pipe negative pressure $P_b$ and the number of revolutions of engine $N_e$ thus read, the target water temperature THW is determined from data map.

In Step S4, it is judged whether it is in warming-up operation or not, i.e. whether TW (cooling water temperature) <THW (target water temperature) or not. If it is judged that it is in warming-up operation in Step S4, the step motor 37 is set to the step value ST=S of totally-closed flow rate or minimum flow rate (micro-flow rate) in Step S5. A signal of the step value S is inputted to the step motor 37 from the control unit 5. By the driving of the step motor 37, the bypass flow regulating value 42 is set to the totally closed flow rate position or to the minimum flow rate position, and the radiator flow regulating valve 42 remains to be closed. In this case, the cooling water in the second bypass passage 16 passes through the restrictor at micro-flow rate. The cooling water in the first bypass passage 15 passes through the throttle body and the EGR valve, and the flow rate is controlled to the totally closed flow rate or to the minimum flow rate. As a result, the warming-up operation is promoted, and the warming-up can be achieved at earlier time. If it is considered that it is not in the warming-up operation in Step S4, it is judged in Step S6 whether warming-up operation has been completed or not. If it is judged that the warming operation has been completed in Step S6, water temperature is controlled in Step S7. In water temperature control in Step S7, target water temperature (step value $S_x$) is obtained from the suction pipe negative pressure $P_b$ and number of revolutions of engine $N_e$ using FIG. 4(*a*). Then, correction factor $K_x$ corresponding to $\Delta T=T1-T2$ is obtained using FIG. 4(*b*). A corrected target water temperature (step value ST) is calculated from "$S_x \times K_x$". Based on the step value ST thus calculated, the step motor 37 is moved step by step and is moved toward the target step value, and it is adjusted to a value closer to the corrected target water temperature by feedback control. For instance, it is controlled in such manner that the engine outlet water temperature T1 is to be the corrected target temperature. When the engine outlet water temperature T1 is turned to a level higher than the corrected target temperature, opening of the flow control valve 3 is increased to raise the radiator flow rate and bypass flow rate toward the corrected target temperature. If it is turned to a level lower than the corrected target temperature, opening of the flow control valve 3 is decreased to reduce the radiator flow rate and the bypass flow rate to a valve closer to the corrected target temperature.

Next, in Step S8, it is judged whether engine load range is constant or not, i.e. whether total load operation or light load operation is continuously performed for a predetermined time or not. If it is judged that engine load range is constant, i.e. when one of either total load operation or light load operation is continuously performed, water temperature control in Step S7 is continuously carried out, and it is advanced to Step S20. When it is judged that the engine load range is not constant in Step S8, i.e. if it is judged that operation is shifted (in transient process) from total load operation to light load operation or from light load operation to total load operation, it is judged in Step S9 whether it is shifted from light load operation to total load operation or not.

When it is judged in Step S9 that it is shifted from light load operation to total load operation, a shift signal is received in Step S10, and operation is set to "hold" state (forcible stop of the step motor 37) for a predetermined time (delay time $t=T_{WOT}$; e.g. 2 seconds) and control operation of Steps S11–S14 is performed, and the radiator flow rate and the bypass flow rate are maintained at the current values. Each time the driver of the vehicle extensively presses accelerator for short time, the step motor 37 is driven, and the next target water temperature control is started. When it goes back to light load operation immediately, the "hold" operation of Step S10 is performed in order to prevent response delay or hunting in the water temperature control. By this "hold" operation, the control operation in Steps S11–S14 can be carried out in reliable manner.

In Step S11, the target water temperature (step value $S_x$; target radiator flow rate and bypass flow rate) is obtained from the suction pipe negative pressure $P_b$ and the number of revolutions of engine $N_e$ using FIG. 4(*a*). Then, the correction factor $K_x$ to match the condition $\Delta T=T1-T2$ is obtained using FIG. 4(*b*). In Step S12, the corrected target water temperature (step value ST) is calculated from the formula of "$ST=S_x \times K_x$". In Step S13, the step motor 37 is driven to the corrected target step value St at a single stroke (not driving step by step). The radiator flow rate and the bypass flow rate of the flow control valve 3 are turned to the flow rate values as calculated. The step motor 37 is stopped, and position of the flow control valve 3 is set to an opening as calculated, and the feedback control is stopped.

In Step S13, the step motor 37 is stopped and the position of the flow control valve 3 is maintained at the calculated opening and the feedback control is stopped. This is because the cooling water temperature TW should reach the target water temperature THW. In Step S14, it is judged whether the cooling water temperature TW is within "target water temperature THW±5° C." or not. If it is judged that the cooling water temperature TW is not within "target water temperature THW±5° C.", it goes back to Step S14. If it is judged in Step 14 that the cooling water temperature TW is within "target water temperature THW±5° C.", the feedback control of water temperature is started again in Step S19.

If it is judged in Step S9 that it is not the shifting from light load operation to total load operation, i.e. when it is judged that it is the shifting from total load operation to light load operation, it is advanced to Step S15. In Step 15, the target water temperature (step value $S_x$; target radiator flow rate and bypass flow rate) is obtained from the suction pipe negative pressure $P_b$ and number of revolutions of engine $N_e$ using FIG. 4(*a*), and the correction factor $K_x$ corresponding to $\Delta T=T1-T2$ is obtained using FIG. 4(*b*). In Step S16, the corrected target water temperature (step value ST) is calculated by the equation $ST=S_x \times K_x$. In Step S17, the step motor 37 is driven at a single stroke to the corrected target step value ST. The position of the flow control valve 3 is set to the calculated opening. The step motor 37 is stopped, and the flow control valve is maintained at the calculated opening, and the feedback control is stopped.

In Step S17, the step motor 37 is stopped. The flow control valve is maintained at the calculated opening, and the feedback control is stopped. This is for the purpose of equalizing the cooling water temperature TW to the target water temperature THW at earlier time. In Step S18, it is judged whether the cooling water temperature TW is within "target water temperature THW±5° C." or not. If it is judged that the cooling water temperature TW is not within "target water temperature THW±5° C.", it goes back to Step S18. If it is judged in Step S18 that the cooling water temperature TW is within "target water temperature THW±5° C.", the feedback control of water temperature is started again in Step S19.

In Step S19, the step motor 37 is moved step by step to move it to the target step value, and it is turned to closer to the target water temperature by the feedback control.

In Step S20, it is judged whether water temperature control should be continued or not. If it is judged that water temperature control should be continued, it goes back to Step S3. If it is judged in Step S19 that water temperature control should not be continued, it is the end of the operation.

FIG. 6 shows control procedure during the warming-up operation and experimental results in a conventional example, a comparative example, and an example according to the present invention. From FIG. 6, it is evident that the example according to the present invention provides better effect in the promotion of the warming-up operation. That is, according to the present invention, the time required for temperature increase from 30° C. to 78° C. is shorter compared with the other examples.

What is claimed is:

1. A cooling water flow control system for an internal combustion engine, comprising a flow control valve at a junction of a radiator passage and a bypass passage, said flow control system being used for control of radiator flow rate and bypass flow rate of the flow control valve by detecting engine outlet water temperature, radiator outlet temperature, number of revolutions of engine, and suction pipe negative pressure, whereby cooling water in the bypass passage passes through a throttle body, and flow rate is set to a totally closed flow rate or a micro-flow rate during warming-up operation.

2. A cooling water flow control system for an internal combustion engine according to claim 1, wherein, when it is shifted from light load operation to total load operation, radiator flow rate and bypass flow rate are maintained at current values for a predetermined time, radiator flow rate and bypass flow rate are calculated from number of revolutions of engine and suction pipe negative pressure after the predetermined time, a correction value is calculated from engine outlet water temperature and radiator outlet water temperature, the flow control valve is quickly controlled to adjust the corrected radiator flow rate and the corrected bypass flow rate and is maintained at its position, and feedback control of water temperature is performed after the cooling water temperature has reached "target water temperature ± preset temperature".

3. A cooling water flow control system for an internal combustion engine according to claim 1 or 2, wherein, when it is shifted from total load operation to light load operation, radiator flow rate and bypass flow rate are calculated from number of revolutions of engine and suction pipe negative pressure, a correction value is calculated from engine outlet water temperature and radiator outlet water temperature, the flow control valve is quickly controlled to adjust to the corrected radiator flow rate and the corrected bypass flow rate and it is maintained at its position, and feedback control of water temperature is performed after the cooling water temperature has reached "target water temperature ± preset temperature".

* * * * *